US010781510B2

(12) United States Patent
Sun et al.

(10) Patent No.: US 10,781,510 B2
(45) Date of Patent: Sep. 22, 2020

(54) THICK STEEL PLATE WITH LOW CRACKING SENSITIVITY AND LOW YIELD RATIO AND MANUFACTURING METHOD THEREOF

(71) Applicant: JIANGYIN XINGCHENG SPECIAL STEEL WORKS CO., LTD, Jiangyin (CN)

(72) Inventors: Xianjin Sun, Jiangyin (CN); Zhuzhong Gao, Jiangyin (CN); Jianguo Hu, Jiangyin (CN); Jingtao Li, Jiangyin (CN); Pifeng Miao, Jiangyin (CN); Xiaolin Wu, Jiangyin (CN); Ailai Shi, Jiangyin (CN); Fu Zhao, Jiangyin (CN); Feng Xu, Jiangyin (CN); Shouyu Fang, Jiangyin (CN)

(73) Assignee: JIANGYIN XINGCHENG SPECIAL STEEL WORKS CO., LTD, Jiangyin (CN)

( * ) Notice: Subject to any disclaimer, the term of this patent is extended or adjusted under 35 U.S.C. 154(b) by 246 days.

(21) Appl. No.: 15/735,489

(22) PCT Filed: Oct. 19, 2016

(86) PCT No.: PCT/CN2016/102490
§ 371 (c)(1),
(2) Date: Dec. 11, 2017

(87) PCT Pub. No.: WO2017/185677
PCT Pub. Date: Nov. 2, 2017

(65) Prior Publication Data

US 2018/0155810 A1 Jun. 7, 2018

(30) Foreign Application Priority Data

Apr. 28, 2016 (CN) ..... 2016 1 0272418

(51) Int. Cl.
*C21D 1/84* (2006.01)
*C22C 38/58* (2006.01)
(Continued)

(52) U.S. Cl.
CPC ..... *C22C 38/58* (2013.01); *C21D 1/84* (2013.01); *C21D 8/0205* (2013.01);
(Continued)

(58) Field of Classification Search
CPC ..... C21D 1/84; C21D 6/02; C21D 8/0263; C22C 38/00
(Continued)

(56) References Cited

FOREIGN PATENT DOCUMENTS

CN 104451387 A * 3/2015
JP 2901890 B2 * 6/1999

OTHER PUBLICATIONS

NPL: on-line English translation of JP 2901890 B2,Nov. 1999 (Year: 1999).*

(Continued)

*Primary Examiner* — Jie Yang
(74) *Attorney, Agent, or Firm* — Yue (Robert) Xu; Apex Attorneys at Law, LLP

(57) ABSTRACT

An ultra-heavy steel plate with low cracking sensitivity and low yield ratio, the mass percentages of chemical components of the steel plate are C 0.05-0.09; Si 0.2-0.4; Mn 1.3-1.6; Al 0.02-0.04; Nb 0.03-0.08; V 0.03-0.08; Cr 0.1-0.5; Ni 0.1-0.5; Mo 0.1-0.3; Cu 0.2-0.5; Ti 0.01-0.02; P≤0.015; S≤0.003; N≤0.007, the balance being Fe and inevitable impurities; the carbon equivalent is ≤0.43, the cold cracking sensitivity coefficient Pcm is ≤0.20. A low cracking sensitivity and low yield ratio steel plate with a thickness of 40-70 mm is manufactured by the process steps of KR molten iron pretreatment-converter smelting-LF refining-RH vacuum degassing-continuous casting-lid-cov- (Continued)

ering slow cooling for the continuous casting slabs-casting slabs heating-controlled rolling-controlled cooling-hot straightening-air cooling and so on.

2 Claims, 1 Drawing Sheet

(51) Int. Cl.

| | |
|---|---|
| ***C22C 38/02*** | (2006.01) |
| ***C22C 38/06*** | (2006.01) |
| ***C22C 38/14*** | (2006.01) |
| ***C22C 38/16*** | (2006.01) |
| ***C22C 38/04*** | (2006.01) |
| ***C21D 8/02*** | (2006.01) |
| ***C22C 38/12*** | (2006.01) |
| ***C22C 38/18*** | (2006.01) |
| ***C22C 38/08*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *C21D 6/02* | (2006.01) |

(52) U.S. Cl.
CPC ..... *C21D 8/0263* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/42* (2013.01); *C22C 38/44* (2013.01); *C22C 38/46* (2013.01); *C22C 38/48* (2013.01); *C22C 38/50* (2013.01); *C21D 6/02* (2013.01)

(58) Field of Classification Search
USPC ..... 148/332
See application file for complete search history.

(56) References Cited

OTHER PUBLICATIONS

NPL: on-line English translation of CN 104451387 A, Mar. 2015 (Year: 2015).*

* cited by examiner

THICK STEEL PLATE WITH LOW CRACKING SENSITIVITY AND LOW YIELD RATIO AND MANUFACTURING METHOD THEREOF

This application is the U.S. national phase of International Application No. PCT/CN2016/102490 filed on 19 Oct. 2016 which designated the U.S. and claims priority to Chinese Application No. CN 201610272418.7 filed on 28 Apr. 2016, the entire contents of each of which are hereby incorporated by reference.

TECHNICAL FIELD

The invention relates to the technical field of steel-forging, and more particularly to an ultra-heavy steel plate with low sensitivity to cracking and low ratio of yield strength to tensile strength (the ratio of yield strength to tensile strength is called as "yield ratio" hereafter, YL (YR)), which is adapted to be applied in low temperature environments at −60° C., and a manufacturing method thereof.

BACKGROUND ART

With ongoing advances of industrial technology and economy, high strength structural steel are increasingly applied in shipbuilding, marine equipment, building structures, railway transportation, bridge construction, large steel structures and other fields. The strength improvement may greatly reduce the total application amounts of steel, which can make the overall construction equipment light in weight and simultaneously reduce the cost of resources. However, as the steel strength improves, it also brings some negative performances when compared with common low alloy structural steel. Wherein, rising of the yield ratio, decreasing of the welding property and decreasing of the low-temperature toughness seriously restrict promotion and development of high strength steel. Low yield ratio, high low-temperature toughness and good weldability have become major development efforts of the third-generation high performance structural steel. Currently, there is no domestic report on 40-70 mm thick, high strength and high toughness steel plate in low-carbon design with low cracking sensitivity and low yield ratio which can be applied at −60° C.

Patent publication No. CN102433507A discloses a low yield ratio, easy-welded high strength steel plate and its manufacturing process, which utilizes low-carbon, Nb and Cr microalloyed component design with a yield strength of 460-560 MPa, a tensile strength of 700-790 MPa and a yield ratio less than 0.7. However, this patent product has a totally different component design from the invention, and concurrently, it can only be applied at the condition of −20° C., not satisfied to be applied at the condition of −60° C. About the thickness gauge, it can only be reached to 30 mm, and cannot guarantee performance for a thicker steel plate.

Patent publication No. CN103114186A discloses a technical solution of controlled cooling method of easy-welded high performance steel plate, which utilizes microalloying element design of low-carbon, Nb, V, Cr, B, Ti and the like, and utilizes controlled rolling and cooling process, obtaining a low yield ratio steel plate having a thickness from 12 mm to 60 mm with Pcm≤0.21, which can be applied at the condition of −40° C., and with a yield strength of more than 530 MPa, a tensile strength of more than 700 MPa, a yield ratio of less than 0.8, and an impact energy at −40° C. of more than 120 J.

SUMMARY OF THE INVENTION

Aimed at the above prior art, the technical problem solved by the invention is to provide high strength steel plates, which can be applied at −60° C. and have a thickness of 40-70 mm, carbon equivalent of ≤0.43, cold cracking sensitivity coefficient (Pcm) of ≤0.20, a yield ratio of ≤0.80, and a manufacturing method thereof.

The technical solution utilized by the invention to solve the above problem is: an easy-welded steel plate with excellent low-temperature lamellar tearing resistant performance, and the mass percentages of the chemical components of the steel plate are C 0.05-0.09; Si 0.2-0.4; Mn 1.3-1.6; Al 0.02-0.04; Nb 0.03-0.08; V 0.03-0.08; Cr 0.1-0.5; Ni 0.1-0.5; Mo 0.1-0.3; Cu 0.2-0.5; Ti 0.01-0.02; P≤0.015; S≤0.003; N≤0.007, the balance being Fe and inevitable impurities, the carbon equivalent is ≤0.43, the cold cracking sensitivity coefficient Pcm is ≤0.20.

The smelting process of steel plate is: KR molten iron pretreatment-BOFconverter smelting-LF refining-RH vacuum degassing-slab continuous casting-slow cooling Slab dehydrogenation process-Slab reheat-controlled rolling-controlled cooling-Test-packaging and storing.

The steel plate of the present application has a thickness of 40-70 mm, a yield strength of ≥460 MPa, a tensile strength of 570-760 MPa, a yield ratio (YR) of ≤0.80, an elongation rate of ≥17%, Charpy impact energy of ≥150 J when it is measured at ¼ thickness and ½ thickness of the steel plates at the temperature of −60° C., a reduction of area in Z direction of ≥35%, which is satisfied to serve at the ultralow-temperature environment of −60° C.

The effects of all components included in the invention and reasons of their contents selection are described in details as follows:

C: a major element affecting strength, low-temperature toughness and weldability; improving steel strength by solid solution strengthening; when the carbon content is too low (lower than 0.03%), the strength cannot be guaranteed, while if the carbon content is too high (higher than 0.10%), it will cause negative impacts on the toughness and weldability of steel. The C content of the invention is selected from the range of 0.05-0.09%, which may guarantee good low-temperature toughness and weldability of the steel plate on the basis of ensuring strength of the steel plate.

Si: a deoxidizing element having solid solution strengthening effect; too high Si content will cause negative impacts on surface quality, toughness and welding property; the Si content of the invention is selected from the range of 0.2-0.4%.

Mn: a major element affecting strength, low-temperature toughness and weldability; a typical austenite stabilizing element having solid solution strengthening effect; the solid solution strengthening effect will be ineffective when the Mn content is lower than 0.8%, while too high Mn content will increase the carbon equivalent of steel and the cracking sensitivity coefficient of steel which may cause negative impacts on the weldability of steel. Meanwhile, Mn may susceptibly generate segregation in the center of the steel plate which may cause negative impacts on the low-temperature impacts toughness of the center of the steel plate. The Mn content of the invention is selected from the range of 1.3-1.6%.

Al: a deoxidizing element having effects of deoxygenation and nitrogen fixation to form AlN functioning as refining grains. The Al content of the invention is selected from the range of 0.02-0.04%.

Nb: a major grain-refining element, which can greatly refine the austenite grains by the pinning effect and precipitation strengthening effect during the rolling process to improve recrystallization temperature of the austenite, which is in favor of improving the strength and toughness. The Nb content of the invention is selected from the range of 0.03-0.08%.

V: a carbonitride-forming element, which can refine ferrite grain size, in the form of dispersion strengthening, by forming V(C, N) to improve the strength and toughness of steel; too high content will cause negative impacts on the weldability. The V content of the invention is selected from the range of 0.03-0.08%.

Cr: a mid-strength carbide forming element, which can greatly improve the hardenability and strength of steel. When added excessively, it will cause negative impacts on the low-temperature impact toughness and the weldability of steel. The Cr content of the invention is selected from the range of 0.1-0.5%.

Ni: it can increase the strength of steel and improve the low-temperature impact toughness simultaneously. When the Ni content is too high, it may produce high viscosity iron oxide scales which may affect surface quality of the steel plate. Meanwhile, too high Ni content will increase the carbon equivalent and the cracking sensitivity coefficient of the steel plate, which may cause negative impacts on the weldability of the steel plate. The Ni content of the invention is selected from the range of 0.1-0.5%.

Mo: it can significantly postpone the pearlite transformation and guarantee to obtain the bainite structure at a lower cooling rate; and for the ultra-heavy steel with low yield ratio, it can guarantee to obtain the ferrite/bainite dual-phase structure over the entire thickness of the section. The Mo content of the invention is selected from the range of 0.1-0.3%.

Cu: it mainly provides the effects of solid solution strengthening and precipitation strengthening, while improves the antiweathering performance of steel and reduces the hydrogen induced cracking sensitivity of steel plate; too high may cause negative impacts on the weldability of the steel plate. The Cu content of the invention is selected from the range of 0.2-0.5%.

Ti: a strong nitride forming element, which provides the effect of precipitation strengthening by forming TiN, and can effectively refine the grains, improves the low-temperature toughness, further improves the recrystallization temperature of austenite by adding combined Nb and Ti; too high content may cause negative impacts on the toughness of the steel plate. The Ti content of the invention is selected from the range of 0.01-0.02%.

P, S: a major impurity element of steel, which may cause negative impacts on the low-temperature impact toughness of the steel plate, particularly the center of the steel plate, thereby lower content is better. According to actual manufacturing conditions, the P and S contents of the invention are separately selected from the range of P≥0.015%, S≤0.003%.

The manufacturing method of the above steel plate with low crack sensitivityand low yield ratio comprises the following steps:

(1) in the steel-making process, producing molten steel with high purity by KR molten iron pretreatment, BOF, LF refining, RH vacuum degassing treatment, then producing a continuous casting slab with a thickness of 150-450 mm by the ultra-heavy slab continuous casting process, thereafter processingthe continuous casting slabs with the treatment of lid-covering stacking slow cooling and hydrogen diffusion (dehydrogenation), wherein the time for dehydrogenation is ≥120 hours;

(2) heating the continuous casting slabs to 1130-1250° C., incubatingfor 150-180 min to cause fully dissolution of the alloy elements in the steel to ensure performance uniformity, and descaling the continuous casting slabs by high pressure water after exiting the furnace;

(3) exerting two stages of rolling on the continuous casting slabs, the first stage is rough rolling with the rolling starting temperature of 1050-1150° C. and reduction of each rolling pass ≥15%; the second stage is finished rolling with the rolling starting temperature of 840-900° C. and the total reduction of the finished rolling ≥60%;

(4) a controlled cooling applied after rolling has two stages, the first stage is an air-cooling stage with the cooling starting temperature of 800-860° C. and the final cooling temperature of 600-750° C.; the second stage is an accelerated cooling stage with the cooling rate of 13-17° C./s and the final cooling temperature of 300-450° C.

(5) after the controlled cooling stage, applying a hot straightening treatment and finally cooling to obtain the steel plate finished-products.

The invention is directed to an ultra-heavy, high strength steel plate with low cracking sensitivity and low yield ratio which is adapted to be applied at the condition of −60° C. For the components, it uses low carbon, low carbon equivalent and low cracking sensitivity coefficient component design; for the process, it uses the smelting of high purity steel and continuous slabs with a thickness of 150-450 mm as raw materials, and applies the controlled rolling and controlled cooling process to manufacture the ultra-heavy, high strength steel plate, which has a thickness of 40-70 mm, low cracking sensitivity and low yield ratio, and is adapted to be applied at the condition of −60° C.

As compared with the prior art, the advantages of the invention include:

(1) The invention applies the low carbon, low carbon equivalent and low cracking sensitivitycomponent design, wherein the C content is 0.05-0.09%, the carbon equivalent is ≤0.43 and the cracking sensitivity Pcm is ≤0.20, to ensure the weldability of the steel plate.

(2) For the ultra-heavy steel plate with a thickness of 40-70 mm according to the invention, on basis of having good weldability, it also has excellent performances of low yield ratio and high low-temperature toughness, and has a yield strength of ≥460 MPa, a tensile strength of 570-760 MPa, a yield ratio of ≤0.80, an elongation rate of ≥17%, Charpy impact energy of ≥150 J when it is measured at ¼ thickness and ½ thickness of the steel plates at the temperature of −60° C., a reduction of area in Z direction of ≥35%, which is satisfied to be applied at the low-temperature condition of −60° C.

DETAILED DESCRIPTION OF THE INVENTION

Figure 1:
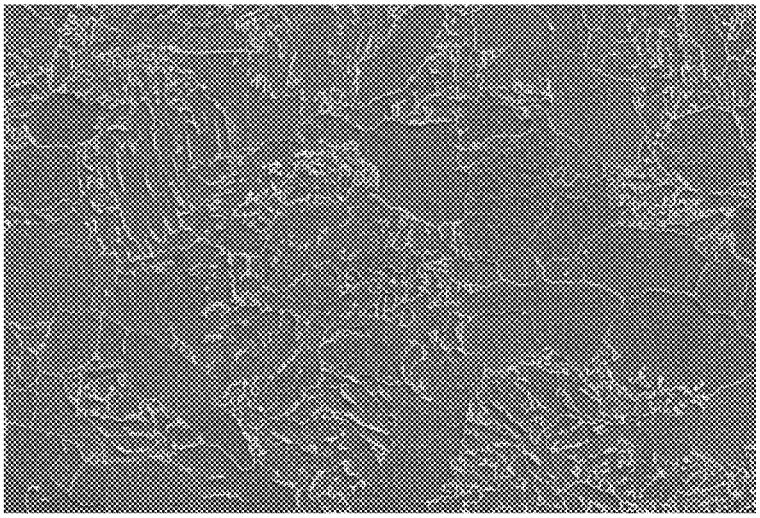
FIG. 1 is a microstructure diagram positioned at ¼ thickness of the 70 mm thicksteel plate according to an embodiment of the invention.

The invention is now described in further details with reference to embodiments shown in the drawings.

Examples 1-2

The steel plate manufacturing method related to the two embodiments: KR molten iron pretreatment-converter smelting-LF refining-RH vacuum degassing-continuous casting-lid-covering slow cooling for the continuous casting slabs-detection and cleaning of the continuous casting slabs-heating of the casting slabs-descaling by high pressure water-controlled rolling-controlled cooling-hot straightening-air-cooling, to manufacture two sets of low cracking sensitivity, low yield ratio and high strength steel plates with a thickness of 70 mm and can be used at low temperature. It is also completely suitable for manufacturing the steel plates having a thickness less than 70 mm.

Specific processes of the above heating, rolling and slow cooling include heating the continuous casting slabs with a thickness of 370 mm to 1180° C. and incubating for 180 min (Example 1), or heating to 1220° C. and incubating for 150 min (Example 2), descaling the continuous casting slabs by high pressure water after exiting the furnace; then applying two stages of rolling, the first stage is rough rolling, the rolling starting temperature is 1060° C. (Example 1) or 1100° C. (Example 2), the thickness of the immediate slab is 240 mm and reduction of the each rolling pass is ≥16%; the second stage has the rolling starting temperature of 860° C. with reduction of accumulated rolling passes 65% (Example 1), or the second stage has the rolling starting temperature of 840° C. with reduction of accumulated rolling passes of 65% (Example 2), the finished steel plates have a thickness of 70 mm (Example 1) and 70 mm (Example 2); after rolling, the steel plates are cooled by air to 680° C. (Example 1) and 650° C. (Example 2); thereafter, an accelerated cooling is applied, with a cooling rate of 13-17° C./s and a final cooling temperature of 400° C. (Example 1) and 430° C. (Example 2), and finally cooling by air to ambient temperature.

Figure 2:
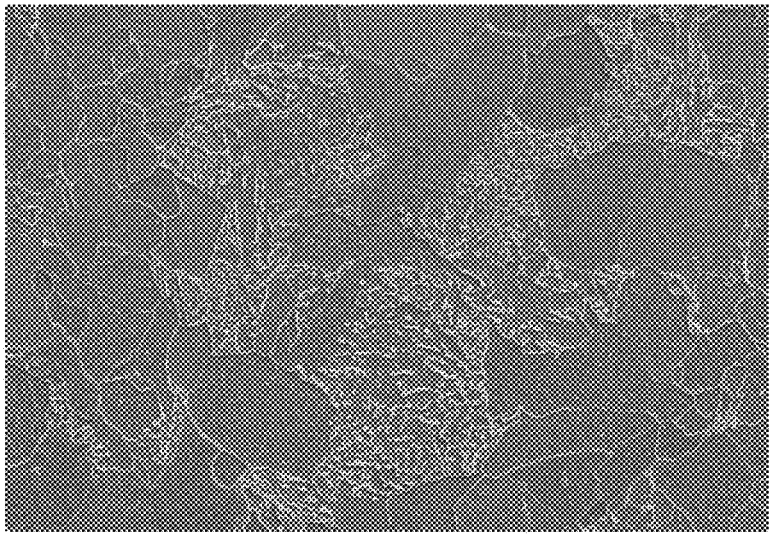
FIG. 2 is a microstructure diagram positioned at ½ thickness of the 70 mm thicksteel plate according to an embodiment of the invention.

The chemical components of the steel plates produced by example 1 and 2 are listed in table 1, the mechanical properties of the steel plates are listed in table 2, and the microstructures positioned at ¼ and ½ thickness of the steel plates are shown in FIG. 1 and FIG. 2.

TABLE 1

The chemical components (wt. %) of the ultra-heavy steel plates with low cracking sensitivity and low yield ratio of examples 1 and 2

| Example | C | Si | Mn | P | S | Al | Nb | V | Ti | Cr | Ni | Mo | Cu | N | Ceq | Pcm |
|---|---|---|---|---|---|---|---|---|---|---|---|---|---|---|---|---|
| 1 | 0.06 | 0.28 | 1.55 | 0.012 | 0.002 | 0.026 | 0.036 | 0.041 | 0.014 | 0.16 | 0.27 | 0.12 | 0.23 | 0.0028 | 0.42 | 0.19 |
| 2 | 0.07 | 0.23 | 1.54 | 0.011 | 0.002 | 0.030 | 0.034 | 0.036 | 0.015 | 0.16 | 0.27 | 0.11 | 0.23 | 0.0027 | 0.42 | 0.19 |

$Ceq = C + Mn/6 + (Cr + Mo + V)/5 + (Ni + Cu)/15$ $Pcm = C + Si/30 + (Mn + Cu + Cr)/20 + Ni/60 + Mo/15 + V/10 + 5B$

TABLE 2

The mechanical properties of the ultra-heavy steel plates with low cracking sensitivity and low yield ratio of examples 1 and 2

| | Thickness/mm | Position | Yield strength/MPa | Tensile strength/MPa | Breaking elongation rate/% | Yield ratio | Impact energy at −60° C./J | Reduction of area in Zdirection/% |
|---|---|---|---|---|---|---|---|---|
| Example 1 | 70 mm | ¼ | 504 | 676 | 26.2 | 0.75 | 252, 236, 247 | 75, 70, 72 |
| | | ½ | 483 | 669 | 27.5 | 0.72 | 205, 196, 216 | |
| Example 2 | 70 mm | ¼ | 498 | 668 | 25.9 | 0.75 | 228, 232, 248 | 73, 75, 70 |
| | | ½ | 479 | 657 | 28.0 | 0.73 | 198, 185, 21 | |

The invention has filled the domestic blank by the components design of ultra-low carbon, low carbon equivalent and low cracking sensitivity and by the low cracking sensitivity, low yield ratio steel plates with a thickness of 40-70 mm which is successfully manufactured by the controlled rolling and controlled cooling process and can be used at the condition of −60° C.

What is claimed is:

1. An steel plate with low cracking sensitivity and low yield ratio (i.e. ratio of yield strength to tensile strength), characterized in that the mass percentages of chemical components of the steel plate are C 0.05-0.09; Si 0.2-0.4; Mn 1.3-1.6; Al 0.02-0.04; Nb 0.03-0.08; V 0.03-0.08; Cr 0.1-0.5; Ni 0.1-0.5; Mo 0.1-0.3; Cu 0.2-0.5; Ti 0.01-0.02; P≤0.015; S≤0.003; N≤0.007, the balance being Fe and inevitable impurities, carbon equivalent $C_{eq}$ is ≤0.43, wherein $C_{eq}$=C+Mn/6+(Cr+Mo+V)/5+(Ni+Cu)/15, cold cracking sensitivity coefficient $P_{cm}$ is ≤0.20, wherein $P_{cm}$=C+Si/30+(Mn+Cu+Cr)/20Ni/60+Mo/15+V/10+5B, microstructure is the ferrite/bainite dual-phase structure over the entire thickness of the section, Charpy impact energy of ≥150 J when it is measured at ¼ thickness and ½ thickness of the steel plates at the temperature of −60° C., and a method for manufacturing the steel plate with low cracking sensitivity and low yield ratio comprises the following process steps:

(1) producing molten steel by KR molten iron pretreatment, converter smelting, LF refining, RH vacuum degassing treatment, then producing a continuous casting slab with a thickness of 150-450 mm by an ultra-heavy slab continuous casting process, thereafter treating the continuous casting slabs with covering by a lid, stacking for slow cooling and hydrogen diffusion, wherein the time of stacking for slow cooling is ≥120 hours;

(2) beating the continuous casting slabs to 1130-1250° C. incubation for 150-180 min, and descaling the continuous casting slabs by water after exiting a furnace;

(3) exerting two stages of rolling on the continuous casting slabs, the first stage is rough rolling with a rolling starting temperature of 1050-1150° C. and reduction ratio of each rolling pass is ≥15%; the second stage is finish rolling with a starting temperature of 840-900° C. and reduction ratio of accumulated rolling passes is ≥60%;

(4) applying a controlled cooling after rolling, the controlled cooling comprising two stages, the first stage is an air-cooling stage with a cooling starting temperature of 800-860° C. and a final cooling temperature of 600-750° C.; the second stage is an accelerated cooling stage with a cooling rate of 13-17° C./s and a final cooling temperature of 300-450° C.; and (5) after the controlled cooling stage, applying a hot straightening treatment, and finally cooling by air to obtain the steel plate finished-products.

2. The steel plate with low cracking sensitivity and low yield ratio according to claim 1, characterized in that the steel plate has a thickness of 40-70 mm, a yield strength of ≥460 MPa, a tensile strength of 570-760 MPa, a yield ratio of ≤0.80, an elongation rate of ≥17%, a reduction of area in Z direction is ≥35%, which can serve at a temperature of −60° C.

* * * * *